United States Patent [19]

LaPorte

[11] Patent Number: 4,775,294

[45] Date of Patent: Oct. 4, 1988

[54] TUBULAR CENTRIFUGAL FAN

[75] Inventor: Vincent M. LaPorte, Farmington Hills, Mich.

[73] Assignee: Twin City Fan & Blower, Minneapolis, Minn.

[21] Appl. No.: 410,366

[22] Filed: Aug. 23, 1982

[51] Int. Cl.[4] ..... F04D 29/60

[52] U.S. Cl. ..... 415/201; 415/217; 415/219 R; 415/DIG. 3; 417/360

[58] Field of Search ..... 415/201, 217, 219 R, 415/118, DIG. 3; 417/360, 361

[56] References Cited

U.S. PATENT DOCUMENTS

| | | | |
|---|---|---|---|
| 2,695,747 | 11/1954 | Miller | 417/360 |
| 2,932,441 | 4/1960 | Harp | 417/360 |
| 3,871,795 | 3/1975 | Habdo et al. | 415/201 |
| 4,092,088 | 5/1978 | Nemesi | 415/201 |
| 4,253,796 | 3/1981 | Phillipps et al. | 415/201 |

*Primary Examiner*—Abraham Hershkovitz
*Assistant Examiner*—John T. Kwon
*Attorney, Agent, or Firm*—Kinney & Lange

[57] ABSTRACT

A centrifugal fan having a tubular housing in which an inlet funnel and fan assembly are contained. The fan assembly includes a fan wheel with the fan wheel inlet and inlet funnel overlapping during normal fan operation. A motor is connected to drive the fan wheel and a door is provided for access to the inside of the housing, the fan wheel assembly and motor being supported by the door for movement therewith. Within the present invention, the door further supports the inlet funnel in overlapping relation with the fan wheel inlet for movement with the door, fan wheel assembly and motor without alteration of the overlapping relation.

10 Claims, 2 Drawing Sheets

TUBULAR CENTRIFUGAL FAN

BACKGROUND OF PRIOR ART

The present invention relates to an improved fan construction which facilitates access to the fan parts for repair or cleaning.

Early, heavy duty industrial fans were typically constructed with the fan and motor assemblies permanently affixed to the fan housing. When cleaning or repair was required, the fan unit was disassembled or access to the fan interior was provided through an access door. Either procedure requires excessive amounts of time. Further, access to all of the parts was often difficult.

An early example of an attempt to overcome the above deficiencies is disclosed in British Patent No. 407,268 which issued to John Marshall, a British subject. The Marshall fan is an axial flow fan employing a propellor to induce the air flow. The fan assembly and motor are carried by an access door which exposes them on opening of the door for cleaning or repair. Inlet fairings for the fan are supported within the housing and are stationary during opening and closing of the door.

A later industrial fan is illustrated in U.S. Pat. No. 3,871,795 issued Mar. 18, 1975, for FAN CONSTRUCTION in the name of Robert T. Habdo et al. The Habdo fan is a centrifugal type which, in its axial flow embodiment, has the fan assembly and motor mounted on the door with the motor being carried by the door outside of the flow path. As is well known in the art, such fans require an inlet funnel for efficient operation, the inlet funnel and fan wheel inlet being overlapped during normal operation. The Habdo funnel is secured within the fan housing requiring that the fan assembly be lifted to provide a clearance between the fan inlet and inlet funnel when the door is opened. This lifting operation is cumbersome and requires a step that may be forgotten prior to door opening to result in damage to the inlet funnel, the fan wheel or both.

Another system which provides an overlap between the fan wheel inlet and the inlet funnel is disclosed in U.S. Pat. No. 4,253,796 issued Mar. 3, 1981, for Fan or Blower Assembly in the name of Philipps et al. The Philipps construction provides an adjustable inlet funnel such that the inlet funnel can be positioned relative to the fan wheel inlet without an overlap. This eliminates the need to lift the fan assembly and the door on door opening. However, failure to properly position the inlet funnel relative to the fan inlet prior to door opening can again result in damage to the inlet funnel, fan wheel or both.

BRIEF SUMMARY OF INVENTION

The present invention provides a centrifugal fan having a tubular housing wherein an inlet funnel and fan assembly are contained. The fan assembly includes a fan wheel in overlapping relation to the inlet funnel during normal fan operation. As with the prior art devices, the motor and fan assembly are supported by a door to provide access to the fan assembly for cleaning or repair on opening of the door. However, the need to lift the door or adjust the relationship between the fan wheel and inlet funnel are avoided by also supporting the inlet funnel on the door in overlapping relation with the fan wheel inlet. Thus, the inlet funnel moves with the door, fan wheel assembly and motor without alteration of the overlapping relation required for normal fan operation.

In a preferred embodiment, the fan of the present invention includes straightening vanes within the tubular housing, at least some of the vanes being carried by the door to provide support for the fan assembly. The door is generally arcuate and has an arc of approximately 180° with the inlet funnel being supported by a member which is secured to the door in surrounding relation to the inlet funnel while allowing fluid flow through that funnel. The housing may be provided with a member mating with the inlet funnel support to seal against a fluid flow outside of the inlet funnel when the door is closed. The motor may be carried outside of the housing to reduce the need for cleaning or protection from the environment within the housing.

DETAILED DESCRIPTION OF INVENTION

Figure 1:
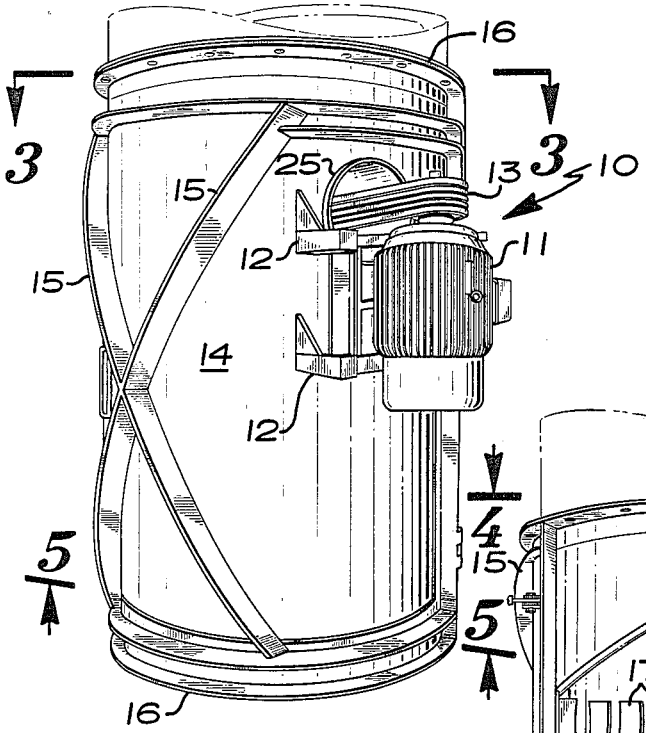
FIG. 1 illustrates a preferred embodiment of the fan of the present invention with the door in closed position.

FIG. 1 illustrates the improved fan of the present invention designated generally at 10 and including a motor 11 supported at the fan exterior by a suitable bracket 12 and having a drive 13 extending into the housing interior to drive the fan assembly, in known manner. Bracket 12 may provide for adjustment of the motor 11 position for alignment of the drive as well as the tensioning thereof.

In the illustration of FIG. 1, that portion of the tubular housing which supports the motor 11 via bracket 12 is a door 14. Cross braces 15, and other reinforcing members, are provided on the door as well as other portions of the housing to enhance the rigidity and weight bearing ability of the housing. Any suitable bracing system may be employed without departing from the scope of the present invention, the configuration of the cross braces 15 following the generally cylindrical configuration of the tubular housing being preferred. Flanges 16 are provided to facilitate the support of the housing and its interconnection with any desired ducting.

Figure 2:
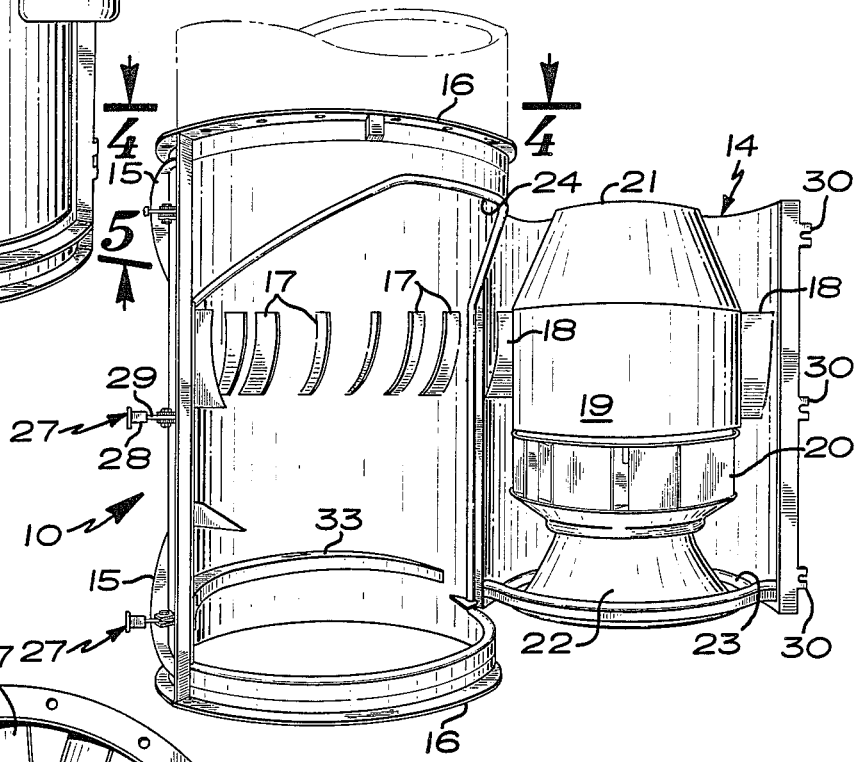
FIG. 2 illustrates the embodiment of FIG. 1 with the door in open position.

FIG. 2 is an illustration of the fan of the present invention viewed in the direction of the view of FIG. 1 with the door 14 in the open position. The fan interior is provided with straightening vanes 17 and 18, the straightening vanes 18 being carried by the door 14 and extending between the interior of the door 14 to a fan assembly 19 to support the fan assembly 19. The fan assembly 19 includes a fan wheel 20 and a diffuser cone 21, in known manner. An inlet funnel 22 is supported by the door as by a plate 23 secured to the interior of the door 14 while allowing a passage of fluid through the inlet funnel 22.

In normal operation, the fan wheel inlet 40 and the inlet funnel 22 are in overlapping relation, the inlet funnel 22 projecting into the fan wheel inlet in most instances. This overlap acts to reduce or prevent recirculation of air discharged by the fan wheel 20 by restricting the flow of that discharge into the fan wheel inlet 40. An opening 24 is provided within the tubular housing to allow positioning of the fan assembly 19 and inlet funnel 22 within the fan housing, as well as its withdrawal, on opening and closing of the door 14.

Figure 3:
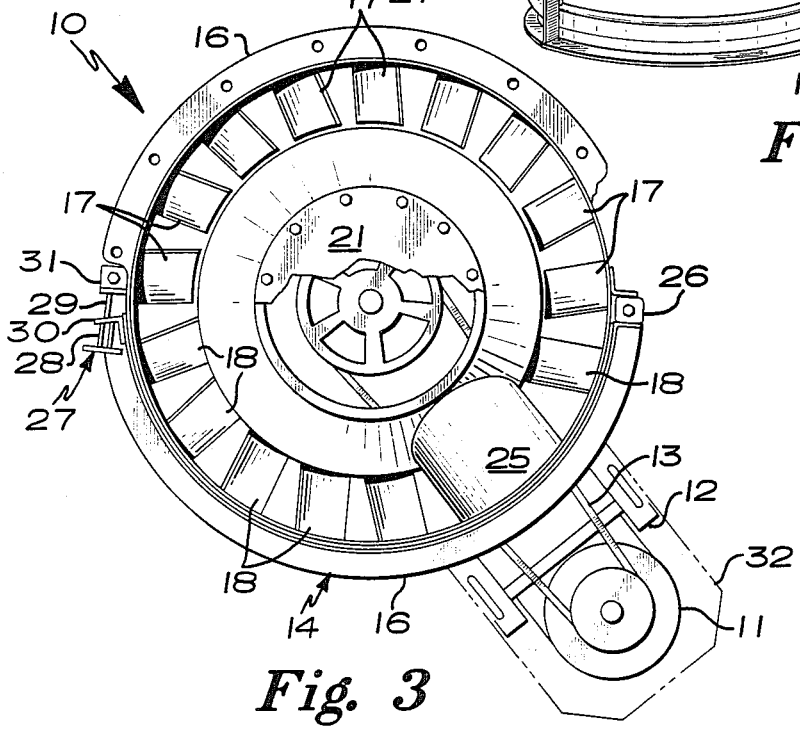
FIG. 3 is a view taken along the line 3—3 in FIG. 1.

FIG. 3 is a partial cutaway of a top view of a preferred embodiment of the present invention as taken along the line 3—3 in FIG. 1. The drive 13 includes a plurality of belts (see FIG. 1) which extend between a pulley driven by the motor 11 and a pulley supported within the fan assembly 19. The pulley within the fan assembly 19 drives a shaft which is connected to drive the fan wheel 20, in known manner. A shroud 25 extends between the interior of the door 14 to the fan assembly 19 and contains the belts of the drive to protect them from the environment within the interior of the fan housing. As illustrated in FIG. 3, the housing is generally cylindrical with the door 14 being arcuate and having an arc of approximately 180° and being supported on one end by hinges 26 (one shown) and secured at the other end by fastening devices 27. The fastening devices 27 may be of a type having a handle 28 threadedly engaged with a threaded bar 29 through a slotted angle 30 carried by the door 14; the bar 29 being secured to the fan housing as with a clevis connection at 31. The motor 11 may be protected from the weather, or other environmental factors, by another shroud 32 of any convenient design.

Figure 4:
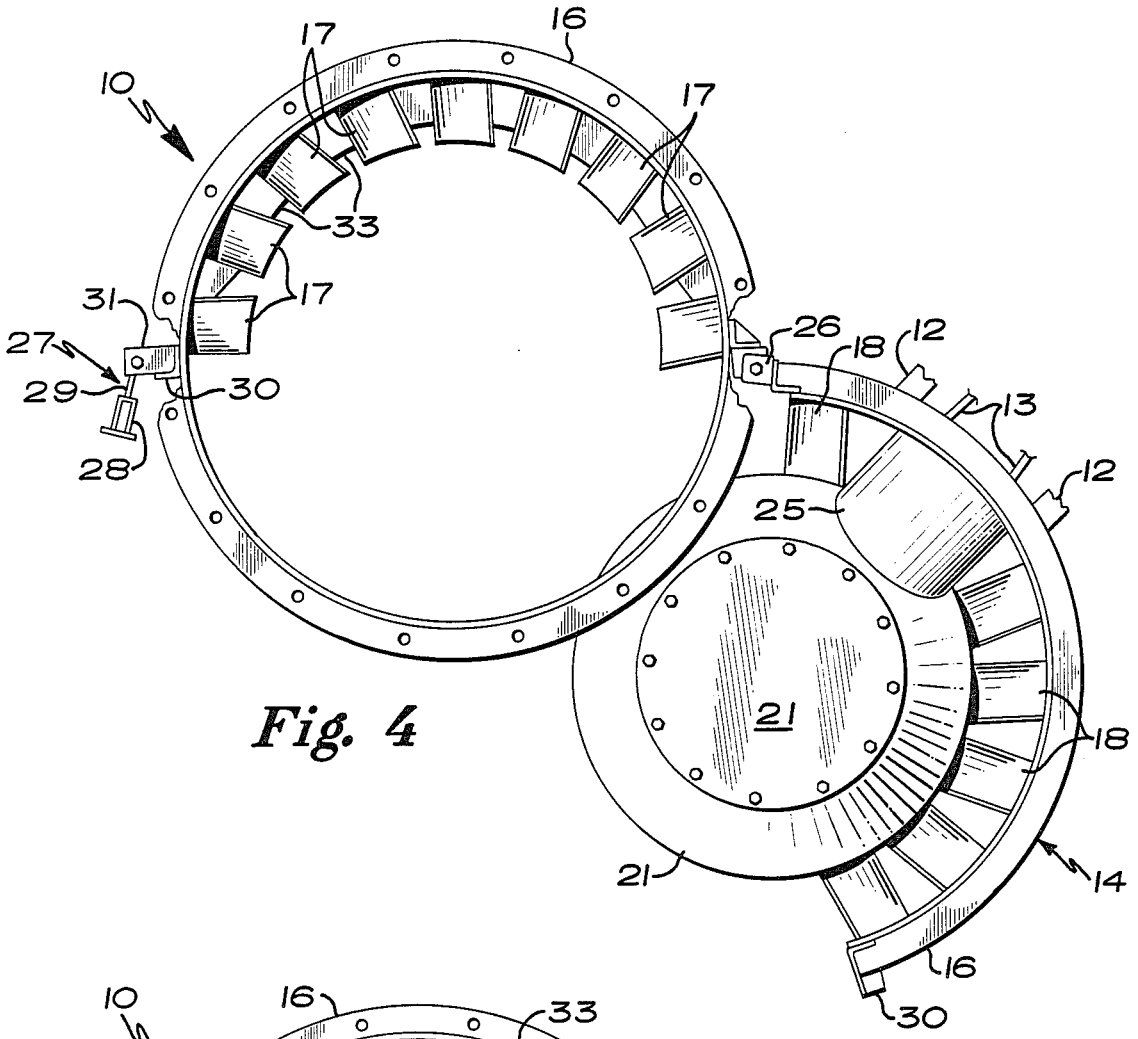
FIG. 4 is a view taken along the line 4—4 in FIG. 2.

FIG. 4 is another top view or a preferred embodiment of the present invention with the door 14 opened, as taken along the line 4—4 in FIG. 2. As easily seen in FIGS. 2 and 4, any required maintenance or cleaning can be efficiently performed by opening the door 14 to expose the entirety of the fan assembly 19 and the inlet funnel 22 without disassembly or entry into the interior of the fan housing. Of course, access to the motor 11 is easily accomplished with the door 14 in either the open or closed position while access to the drive within cone 21 is provided by removing the cover plate at the top of the cone 21.

Figure 5:
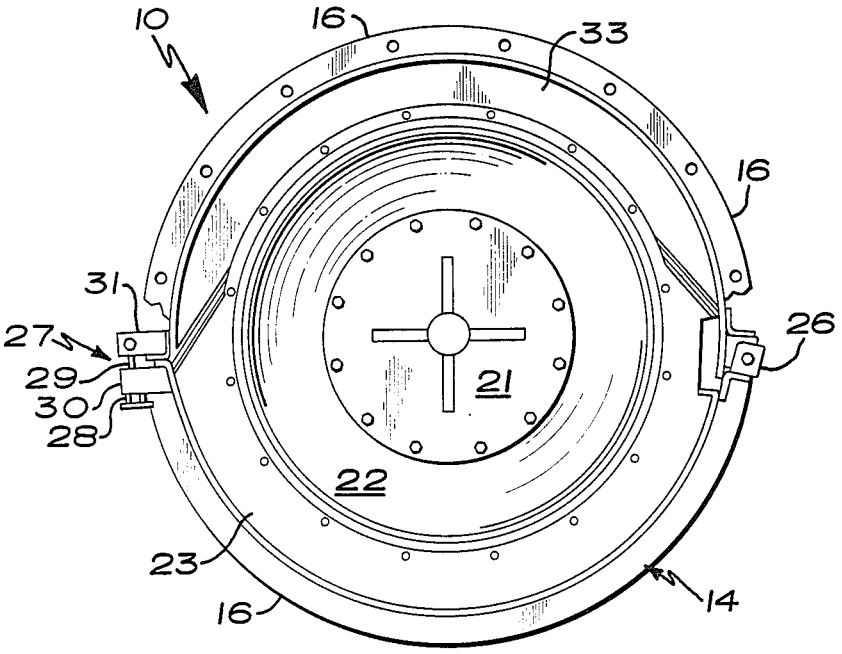
FIG. 5 is a view taken along the line 5—5 in FIG. 1.

FIG. 5 illustrates a bottom view of a preferred embodiment of the present invention as viewed along the line 5—5 in FIG. 1. As seen in FIG. 5, the inlet funnel 22 is supported by a plate 23 extending from the door 14 and generally surrounding the inlet funnel 22 while leaving the central passage of the inlet funnel 22 unobstructed for the passage of fluid therethrough. A cooperating plate 33 (see also FIGS. 2 and 4) is carried by the housing 10 in mating relation to the plate 23 to provide a seal against the flow of fluids outside of the funnel 22. The abutments between the plates 23 and 33 may be provided with gaskets or other sealing devices to enhance the sealing relationship of the plates 23 and 33.

Obviously, many modifications and variations of the present invention are possible in light of the above teachings. For example, any suitable fastening device may be employed in place of the fasteners 27 described above. Further, gaskets or other sealing materials may be provided between the housing 10 and/or 14 to enhance the efficiency of operation of the fan of the present invention. Also, other support devices for the fan assembly 19 and inlet funnel 22 may be employed within the constraint that they be supported by the door 14 with the inlet funnel 22 in overlapping relation to the inlet to fan wheel 20. It is therefore to be understood that, within the scope of the appended claims, the invention may be practiced otherwise than as specifically described.

I claim:

1. In a centrifugal fan of the type having a tubular housing containing an inlet funnel and a fan assembly including a fan wheel having a fan wheel inlet, the fan wheel inlet and inlet funnel overlapping during normal fan operation, having motor means connected to drive said fan wheel and having a door providing access to the inside of said housing, the fan wheel assembly and motor, being supported by said door for movement therewith, the improvement wherein said door further supports said inlet funnel in overlapping relation with said fan wheel inlet for movement with said door, fan wheel assembly and motor without alteration of said overlapping relation.

2. The centrifugal fan of claim 1 further comprising straightening vanes within said housing including straightening vanes carried by said door.

3. The centrifugal fan of claim 2 wherein said door carried straightening vanes provide support for said fan assembly.

4. The centrifugal fan of claim 1 wherein said tubular housing is generally cylindrical, said door being arcuate having an arc of approximately 180°.

5. The centrifugal fan of claim 1 further comprising inlet funnel support means carried by said door and surrounding said inlet funnel while allowing fluid flow through said funnel.

6. The centrifugal fan of claim 5 further comprising means carried by said housing and mating with said inlet funnel support means for sealing against fluid flow outside said inlet funnel when said door is closed.

7. The centrifugal fan of claim 6 further comprising straightening vanes within said housing including straightening vanes carried by said door.

8. The centrifugal fan of claim 7 wherein said door carried straightening vanes provide support for said fan assembly.

9. The centrifugal fan of claim 8 wherein said tubular housing is generally cylindrical, said door being arcuate having an arc of approximately 180°.

10. The centrifugal fan of claim 9 wherein said motor is carried by said door outside of said tubular housing.

* * * * *